United States Patent [19]

Drewke et al.

[11] Patent Number: 4,735,600

[45] Date of Patent: Apr. 5, 1988

[54] APPARATUS FOR SEPARATING AND ERECTING FOLDING BOXES

[75] Inventors: Wolfgang Drewke, Rudersberg; Otto Weller, Waiblingen, both of Fed. Rep. of Germany

[73] Assignee: Robert Bosch GmbH, Stuttgart, Fed. Rep. of Germany

[21] Appl. No.: 929,863

[22] Filed: Nov. 13, 1986

[30] Foreign Application Priority Data

Feb. 26, 1986 [DE] Fed. Rep. of Germany ..... 3606093

[51] Int. Cl.[4] ..... B31B 1/80

[52] U.S. Cl. ..... 493/314; 493/315; 493/319; 271/12; 271/31.1; 271/95; 53/566

[58] Field of Search ..... 493/314, 315, 319; 271/12, 94, 95, 99, 31.1; 414/128, 129; 53/566

[56] References Cited

U.S. PATENT DOCUMENTS

| | | | |
|---|---|---|---|
| 2,827,287 | 3/1958 | Gross et al. | 271/11 |
| 3,148,876 | 9/1964 | Chandler et al. | 271/12 |
| 3,372,924 | 3/1968 | Treff | 271/12 |
| 3,728,945 | 4/1973 | Vuilleumier | 53/53 |
| 4,526,564 | 7/1985 | Hughes | 493/314 |

FOREIGN PATENT DOCUMENTS

| | | |
|---|---|---|
| 0027968 | 5/1981 | European Pat. Off. . |
| 2260936 | 6/1973 | Fed. Rep. of Germany . |
| 2923909 | 12/1980 | Fed. Rep. of Germany . |

*Primary Examiner*—Frederick R. Schmidt
*Assistant Examiner*—William E. Terrell
*Attorney, Agent, or Firm*—Edwin E. Greigg

[57] ABSTRACT

An apparatus for separating and erecting foldable boxes has a supply magazine for foldable boxes, a removal device with revolving suction grippers, and an endless conveyor device provided with carriers and blower nozzles, which are disposed laterally of the conveyor apparatus with the blower nozzles arranged to inflate the conveyed foldable boxes. The suction grippers pull the foldable boxes out of the magazine seriatim in the direction in which the foldable boxes extend and transfer them to the conveyor apparatus such that they lie flat on an arc-like stretch. For guiding the chains of the conveyor device and for guiding the foldable boxes in the arc-like stretch, arc-like curved guide rails are disposed on the revolving path of the suction grippers following the magazine. The blower nozzles are associated with a straight stretch of the conveyor device.

5 Claims, 1 Drawing Sheet

APPARATUS FOR SEPARATING AND ERECTING FOLDING BOXES

BACKGROUND OF THE INVENTION

The invention is based on an apparatus for separating and erecting folding boxes as defined hereinafter. In an apparatus of this type known for example from European patent application No. 27 968, a pivoting suction device pulls the forwardmost folding box in the magazine crosswise to its extension surface and pivots it, again crosswise to its extension surface, to face a carrier of the conveyor device. This conveyor device guides the folding box, which has been transferred to a straight stretch, into a deflection path where blades that revolve coaxially and are displaceable axially parallel with one another are inserted into the conveyed folding boxes and rotated, causing the folding box that was originally lying flat to be erected in three dimensions, while being held against a side wall by revolving suction heads. The disadvantage of this known apparatus is that when a folding box is lifted from the magazine quickly, successive folding boxes are carried along as well.

An apparatus for separating and erecting folding boxes is also known from German Offenlegungsschrift No. 29 23 909, in which a plurality of suction grippers are disposed on a revolving rotor; they pull the forwardmost folding box from a magazine substantially in the direction of extension of the folding boxes and deliver it to an adjoining curved revolving stretch of a conveyor device of a cartoning machine. In this apparatus, the suction grippers have erecting levers associated with them, which, on the revolving stretch of the suction grippers, pivot a folding box wall not grasped by the suction gripper and thereby set the box upright. This known apparatus is mechanically quite expensive because of the erecting levers associated with the rotating suction grippers. Also, it is not always assured that the the folding boxes will be erected by having pressure exerted on one of their walls, depending on the stresses prevailing in the folding boxes as they lie flat.

Finally, German Offenlegungsschrift No. 22 60 936 also discloses an apparatus for separating and erecting folding boxes, in which the folding boxes, lying flat, are successively pushed in the extension direction, by means of carriers of a conveyor device, out of a magazine that holds folding boxes stacked on one another and are moved past blowers, where the flow of air into them opens the folding boxes. The disadvantage of this apparatus is that folding boxes of thin paperboard cannot be separated very well, and there is also the danger that they will be damaged when pushed at high speed.

OBJECT AND SUMMARY OF THE INVENTION

The apparatus according to the invention has the advantage that the folding boxes can be removed separately from the magazine at high speed and that they reliably open when moved past the blower nozzles. A further advantage is that the apparatus according to the invention can handle folding boxes having various cross-sectional formats without having to adjust elements in the folding box removal or transfer areas and without having to reset the various members with respect to one another in terms of their movement phase.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figures 1, 2, 3:
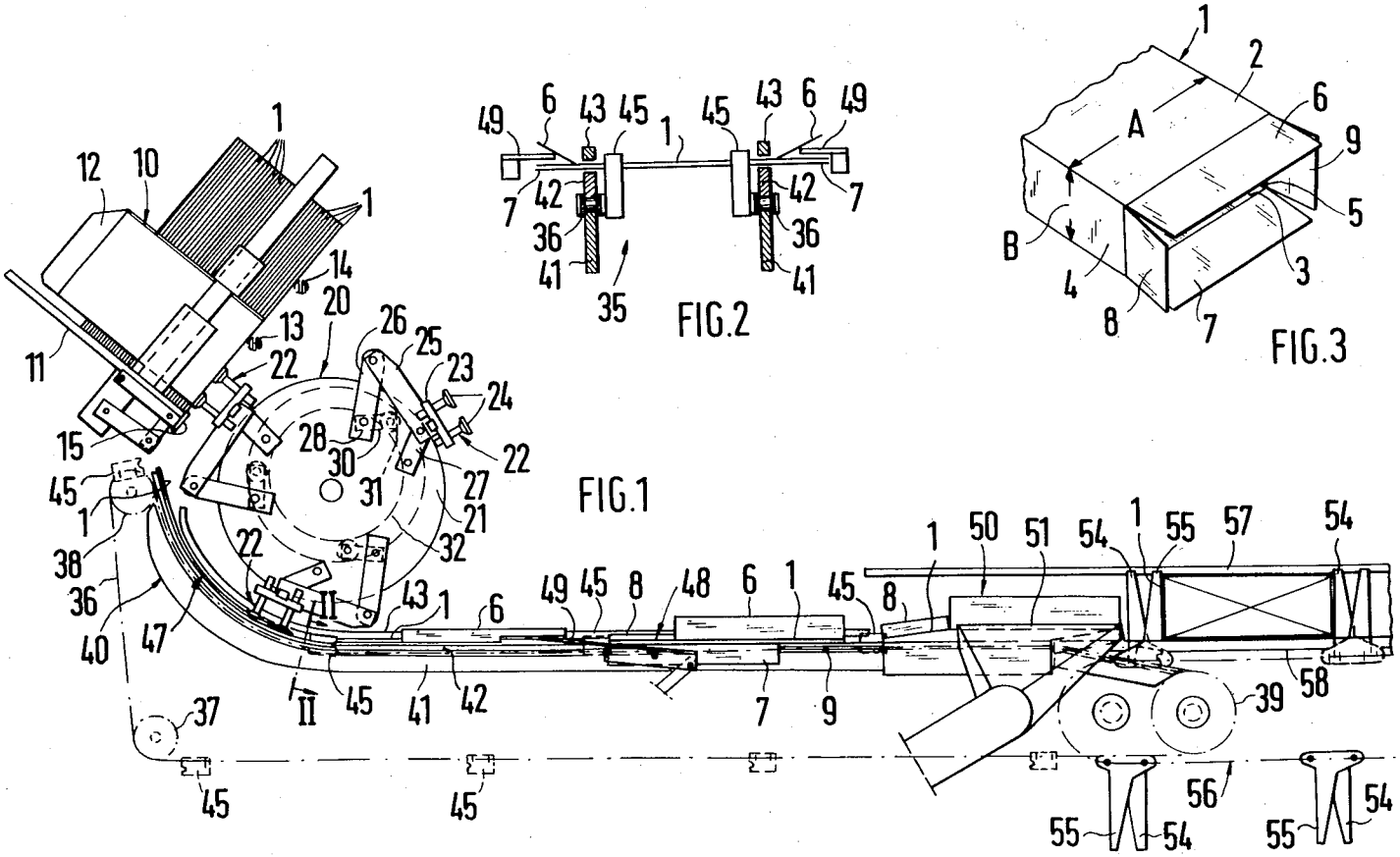
FIG. 1 shows a folding box separating and erecting apparatus in simplified form, in a side view.
FIG. 2 shows a conveyor device of the apparatus of FIG. 1 in cross section, in the plane I—I of FIG. 1.
FIG. 3 shows a folding box in perspective.

Folding boxes 1 that are to be filled in a cartoning machine are supplied lying flat in stacks, which are inserted into a magazine 10 to serve as provisions. In the erected state, the folding boxes 1 have a rectangular cross section, with two parallel side walls 2, 3 having the dimension A and two narrow side walls 4, 5 having the dimension B. Closure flaps 6–9 adjoin both openings of the sheath-like folding box 1.

The magazine 10 is placed on an angle of approximately 45° with the horizontal and has a bottom 11, two side walls 12 and two rods 13, 14 defining the front side and supporting the stack of folding boxes. Associated with the front end of the bottom 11 is a retainer stub 15, which is movable up and down in increments and retains the forwardmost folding box 1 in the magazine by pressing on its lower edge.

To remove folding boxes 1 in order from the magazine 10, a removal device 20 is disposed in front of and below the magazine. This removal device 20 has a continuously revolving rotor 21, with for instance three suction grippers 22 distributed uniformly over its circumference. The suction grippers 22 each have two suction devices 24 secured to a holder 23. The holders 23 are in turn each secured to a four-bar mechanism, in particular to the coupler 25 thereof, which is pivotably connected to a crank 26 and an oscillating crank 27, which are pivotably supported on the rotor 21. The rotation shaft 28 of the crank 26 is firmly connected to a roller lever 30, the roller 31 of which is guided in a stationary annular cam groove 32 that is disposed eccentrically with respect to the axis of revolution of the rotor. The cam groove 32 is disposed and arranged such that it speeds up the suction grippers 22 during their revolution with the rotor 21 for grasping the forwardmost folding box 1 in the magazine 10, while retarding them while they grasp the folding box 1 and subsequently speeding them up again, all as compared with the uniform revolving movement of the rotor 21. When a suction gripper 22 meets the forewardmost folding box 1 in the magazine 10, which it does in the vicinity of its lower folding edge on which the box stands on the bottom 11, the suction devices 24 are subjected to negative pressure, so that upon being applied to the folding box wall facing them they grasp it and pull the folding box 1 out of the stack in the direction of its extension. In this process the folding box 1 is pulled slidingly downward from the stack over the retainer stub 15 and sliding on the rods 13, 14.

A conveyor device 35 extends below the magazine 10 and removal device 20. This conveyor device 36 has two parallel endless chains 36, which are endlessly guided about deflecting rollers 37, 38, 39. The upper run of the conveyor chains 36, extending between the deflecting rollers 38 and 39, is guided between upper and lower pairs of guide rails 41, 42. The entry end of the guide rails 41, 42 extending below the magazine 10 and removal device 20 is curved in arc-like fashion, while contrarily the part adjoining it extends in a straight line in a horizontal plane. The curvature of the entry part of the guide rails 41, 42 is adapted to the revolving path of the suction grippers 22. Disposed above the upper guide rails 42 for the conveyor chains 36 is a third pair of guide rails 43, which extends in an adapted shape similar to the guide rails 42, leaving a slight gap. Thus in the entry region 40 below the magazine 10 and removal device 20, an arc-like conveyor stretch 47 and following it a straight conveyor stretch 48 are formed. The two conveyor chains 36 have carriers 45 at equal intervals, which protrude outward into the conveyor stretches 47, 48 in the region beside the rails 42, 43.

As the rotor 21 revolves, the suction grippers 22 pull one folding box 1 at a time downward out of the magazine 10 and then convey it to the arc-like stretch 47. The gap between the two guide rails 42 and 43 in their entry region 40 matches this arc-like stretch 47. Similarly, the gap between the guide rails 41 and 42 is adapted in its curvature for guiding the conveyor chains 36. A folding box 1 grasped by a suction gripper 22 is introduced, with its folding edge in the lead, into the arc-like gap between the guide rails 42 and 43, whereupon it also bends in arc-like fashion and thereby gains a certain inherent stability. During the continuous revolution of the suction grippers 22 and the carriers 45, one carrier 45 approaches the upper, trailing folding edge of the folding box 1 and finally overtakes it. At this instant, or even earlier, the negative pressure for the suction devices 24 of the suction gripper 22 is shut off, causing the suction devices to release the folding box 1 they have carried along. The carriers 45 of another carrier pair now run up against the trailing folding edge of the folding box 1 and push the folding box 1 through the arc-like stretch 47 and then through the straight stretch 48 in the gap between the guide rails 42 and 43. The guide rails 42, 43 of the pair of guide rails are spaced apart, so that a folding box 1 is guided in the vicinity of its side walls 2–5 near the closure flaps 6–9, and the closure flaps extend freely to the side at both ends. Prior to the complete erection of the folding boxes 1, during the passage through the straight stretch 48, the wide closure tabs 6 and 7 of the folding boxes are folded upward and downward, respectively, by means of folding blades 49 that are periodically pivoted up and down, and are held in this position by folding means, not shown.

In the exit region of the guide rails 41–43, the upper guide rail 43 ends more than one folding-box width before the guide rail 42 located beneath it. In the exit region 50, blower nozzles 51 having a large cross section are disposed laterally of the guide path for the folding boxes 1 and are aimed at the openings of the folding boxes 1. As a folding box 1 and a carrier pair 45 travel past them, blown air flows out of the blower nozzles 52 and flows into the openings of the conveyed folding boxes 1, and the resultant pressure causes the folding box 1 that was initially lying flat to be erected while being conveyed. The carrier pair 45 pushes the partially or completely erected folding box 1 into the space between two carriers 54, 55 which are carried by the upper and lower flights of an adjoining synchronously revolving conveyor device 56 of a cartoning machine, where it is then guided between upper and lower guide rails 57, 58 to a station where it will be filled.

In the apparatus described, the removal and erecting of the folding boxes take place in separate regions. As a result, the apparatus is simple and easily understood. The apparatus has the advantage, however, that if there is a change in folding box format with a different cross section, a conversion to this new format is unnecessary. Since the leading folding edge of the folding boxes 1, when transferred by the suction grippers 22 to near the leading carrier 45 of the conveyor apparatus 35, serves in all formats as the reference edge, and since subsequently the trailing carrier pair 45, after release of the folding box by the suction gripper 22 takes the trailing folding edge of the folding box 1 as the reference edge, differences in format are compensated for in the transition from transport by suction grippers to transport by carriers.

The foregoing relates to a preferred exemplary embodiment of the invention, it being understood that other variants and embodiments are possible within the spirit and scope of the invention, the latter being defined by the appended claims.

What is claimed and desired to be secured by Letter Patent of the United States is:

1. An apparatus for separating and erecting foldable boxes, comprising a magazine adapted to contain a stack of flat boxes provided with flaps extending outwardly from opposite sides thereof, at least one movable gripper means adapted to remove said flat boxes seriatim from said magazine, an endless conveyor having opposite side portions provided with carriers positioned in proximity to said magazine and said gripper means, said gripper means adapted to successively remove one of said flat boxes from said magazine and thereafter transfer said flat box to said endless conveyor, means for revolving said gripper means to transverse an arc-shaped path to which the forwardmost of said foldable boxes in said magazine, is tangent said endless conveyor including an arcuate portion which conforms to said arc-shaped path of said gripper means and further includes a horizontal planar portion co-terminus with said arcuate portion which lies in a horizontal plane, said endless conveyor being guided by oppositely disposed spaced arc-like guide rails spaced on an arc-like stretch adjacent to said magazine and said arc-shaped path of said gripper means and blower means disposed in a zone laterally of said horizontal planar portion of said endless conveyor, said blower means being adapted to erect said flat boxes seriatim into an open position by emitting pressurized air through nozzles into said flat boxes.

2. An apparatus as defined by claim 1, in which said arc-like guide rails form a path for the arc-like stretch of said endless conveyor, and further that said guide rails are arranged to define a guide gap for guiding said foldable boxes in the arc-shaped path of the gripper means.

3. An apparatus as defined by claim 1, which includes a trigger mechanism in which said endless conveyor is further arranged to actuate said trigger mechanism to control discharge of said pressurized air through said blower means into said foldable boxes.

4. An apparatus as defined by claim 1, which includes a linear aligned contiguous conveyor device having upper and lower flights which further include uniformly spaced carrier means, said carrier means along said upper flight adapted to confine said foldable boxes to an erected configuration subsequent to said foldable boxes passing through said zone having said blower means and which enter a spacing between said spaced carrier means along said upper flight of said contiguous conveyor device.

5. An apparatus as defined by claim 1, in which periodically actuated means spaced outwardly from each side of said endless conveyor are adapted to move said flaps on said foldable boxes out of the horizontal plane transversed by said endless conveyor.

* * * * *